US007967170B2

(12) United States Patent
Goff et al.

(10) Patent No.: US 7,967,170 B2
(45) Date of Patent: Jun. 28, 2011

(54) METHOD AND APPARATUS FOR A FRONT ACCESS REMOVABLE AGITATOR MOTOR

(75) Inventors: David Goff, San Antonio, TX (US); Adrian M. Romanyszyn, San Antonio, TX (US); Todd Jenkins, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 12/799,818

(22) Filed: May 3, 2010

(65) Prior Publication Data

US 2010/0219208 A1 Sep. 2, 2010

Related U.S. Application Data

(63) Continuation of application No. 10/999,422, filed on Nov. 30, 2004, now Pat. No. 7,748,571.

(51) Int. Cl.
*B67D 7/80* (2010.01)

(52) U.S. Cl. ..... 222/146.6; 222/235; 222/240; 222/333; 222/410

(58) Field of Classification Search ..... 222/333, 222/240–242, 235–236, 410, 414, 146.6; 62/344, 400
See application file for complete search history.

(56) References Cited

U.S. PATENT DOCUMENTS 2,609,992 A * 9/1952 Matthews ..... 241/56
2,865,571 A * 12/1958 Ferdon ..... 241/157
2,899,140 A * 8/1959 Hellyer ..... 241/190
3,101,872 A * 8/1963 Dickinson ..... 222/197
3,144,965 A * 8/1964 Burton et. al. ..... 222/108
3,327,903 A * 6/1967 Waller ..... 222/227
3,715,119 A * 2/1973 Shelley et al. ..... 222/241
4,154,536 A * 5/1979 Sokolow ..... 366/90
4,158,426 A * 6/1979 Frohbieter ..... 222/1
4,187,992 A * 2/1980 Del Valle ..... 241/65
4,215,803 A * 8/1980 Schafer ..... 222/240
4,972,999 A * 11/1990 Grace ..... 241/30
5,104,007 A * 4/1992 Utter ..... 222/146.6
5,169,075 A * 12/1992 Galanty ..... 241/46.04
5,299,716 A * 4/1994 Hawkins et al. ..... 222/146.6
5,603,229 A * 2/1997 Cocchi et al. ..... 62/343
7,748,571 B2 * 7/2010 Goff et al. ..... 222/146.6

* cited by examiner

*Primary Examiner* — Frederick C. Nicolas

(74) *Attorney, Agent, or Firm* — Christopher L. Makay

(57) ABSTRACT

An agitator motor assembly is removable from a front of an ice dispenser for servicing, thereby eliminating the need to gain entrance into a storage bin to uncouple the agitator motor assembly from an agitator bar assembly. The ice dispenser includes the storage bin having a port, the agitator bar assembly disposed within the storage bin, and the agitator motor assembly mounted to a front of an exterior portion of the bin. A shaft of the agitator motor assembly engages the agitator bar assembly through the port, such that the agitator motor assembly rotates the agitator bar assembly when powered. The agitator motor assembly further includes a fastening device that passes through a bore in the shaft and engages the agitator bar assembly, thereby coupling the agitator motor assembly to the agitator bar assembly. A method for removing the agitator motor assembly is also provided.

14 Claims, 8 Drawing Sheets

METHOD AND APPARATUS FOR A FRONT ACCESS REMOVABLE AGITATOR MOTOR

CROSS-REFERENCE TO RELATED APPLICATION

This application is a continuation of U.S. application Ser. No. 10/999,422, which was filed Nov. 30, 2004 now U.S. Pat. No. 7,748,571.

BACKGROUND OF THE INVENTION

1. Field of the Invention

The present invention relates to product dispensing and, more particularly, but not by way of limitation, to methods and an apparatus for removing a front access agitator motor without entrance into a storage bin of an ice dispenser.

2. Description of the Related Art

In the area of product dispensing, dispenser manufacturers have created integrated dispensers that provide both the beverage and the ice used to cool the beverage. Customers are able to dispense the ice from a storage bin located within the dispenser. The storage bin may be filled manually, or automatically through the use of an icemaker located on top of the dispenser. A means of agitation is used to move ice towards a drop chute, or in cases where ice sits for extended periods between dispenses, it must be agitated to prevent excessive bridging. Ice housed in the storage bin is agitated by an agitator motor that is located on a front of the dispenser. A shaft of the agitator motor passes through a port in the storage bin to engage a paddlewheel and an agitator bar within the storage bin. In most cases, the agitator bar is coupled to the paddlewheel and shaft with some type of fastener, for example, pins, clips, or thumbscrews. As the agitator motor turns, the agitator bar rotates to break up the ice bridges.

Problems with this system arise when the fastener becomes dislodged or breaks during use. A loose or broken fastener may end up in the ice dispense path and be dispensed into an operator's cup.

A second problem with the ice dispensing system arises when the agitator motor must be serviced. With the current system, the agitator motor must be disconnected from the agitator bar assembly and the paddlewheel before being removed. As such, technicians must gain entrance to the ice storage bin to disengage the coupling apparatus from the agitator motor assembly. This may also entail removing at least some portion of the ice located within the storage bin.

Further complications arise when the storage bin is automatically filled, as there is now an icemaker situated in the access port of the storage bin. In this arrangement, the icemaker must be moved to provide access into the storage bin; however, movement of most icemakers in the service industry is accomplished by an icemaker specialist. The requirement for an icemaker specialist at a service call in addition to a service technician increases the labor cost associated with the particular task, in this case, servicing of the agitator motor.

Accordingly, an apparatus that removes fastening hardware from the storage bin, and provides for the removal and servicing of the agitator motor without requiring the removal of attached icemakers would be beneficial to beverage dispenser manufacturers.

SUMMARY OF THE INVENTION

In accordance with the present invention, an agitator motor assembly provides the ability to remove or service the agitator motor assembly from a front of an ice dispenser. The front removable agitator motor assembly eliminates the need to gain entrance to the storage bin in the ice dispenser to uncouple the agitator motor assembly from the agitator bar assembly. The ice dispenser includes a storage bin having a port, an agitator bar assembly disposed within the storage bin, and agitator motor assembly mounted to a front of an exterior portion of the bin. A shaft of the agitator motor assembly engages the agitator bar assembly through the port, such that the agitator motor assembly rotates the agitator bar assembly to break up ice bridges within the storage bin when the agitator motor assembly is powered. The agitator motor assembly further includes a bore through the shaft to allow a fastening device to pass through the agitator motor assembly and engage the agitator bar assembly, thereby coupling the agitator motor assembly to the agitator bar assembly.

A method is also provided for removing an agitator motor assembly from a front of an ice dispenser, thereby separating the agitator motor assembly from an associated agitator bar assembly.

It is therefore an object of the present invention to remove an agitator motor assembly from a front of an ice dispenser without gaining entrance to a storage bin.

It is a further object of the present invention to uncouple an agitator motor assembly from an agitator bar assembly using a fastening device passing through a bore of an output shaft of the agitator motor assembly.

It is still further an object of the present invention to couple an agitator motor assembly to an agitator bar assembly from a front of an ice dispenser using a fastening device.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

A front access agitator motor assembly provides the ability to remove and service the agitator motor from a front of a product dispenser without accessing a storage bin, thereby eliminating the need to temporarily move icemakers located atop the product dispensers for access into the storage bin. The front access agitator motor assembly further eliminates the need to utilize an icemaker specialist and a service technician in an equipment service organization. Use of the front access agitator motor assembly eliminates coupling hardware located within the storage bin, as well as the possibility of dispensing broken or dislodged coupling hardware from the storage bin. The front access agitator motor assembly may be removed and replaced without affecting the alignment of the paddlewheel and the agitator bar.

Figure 1:
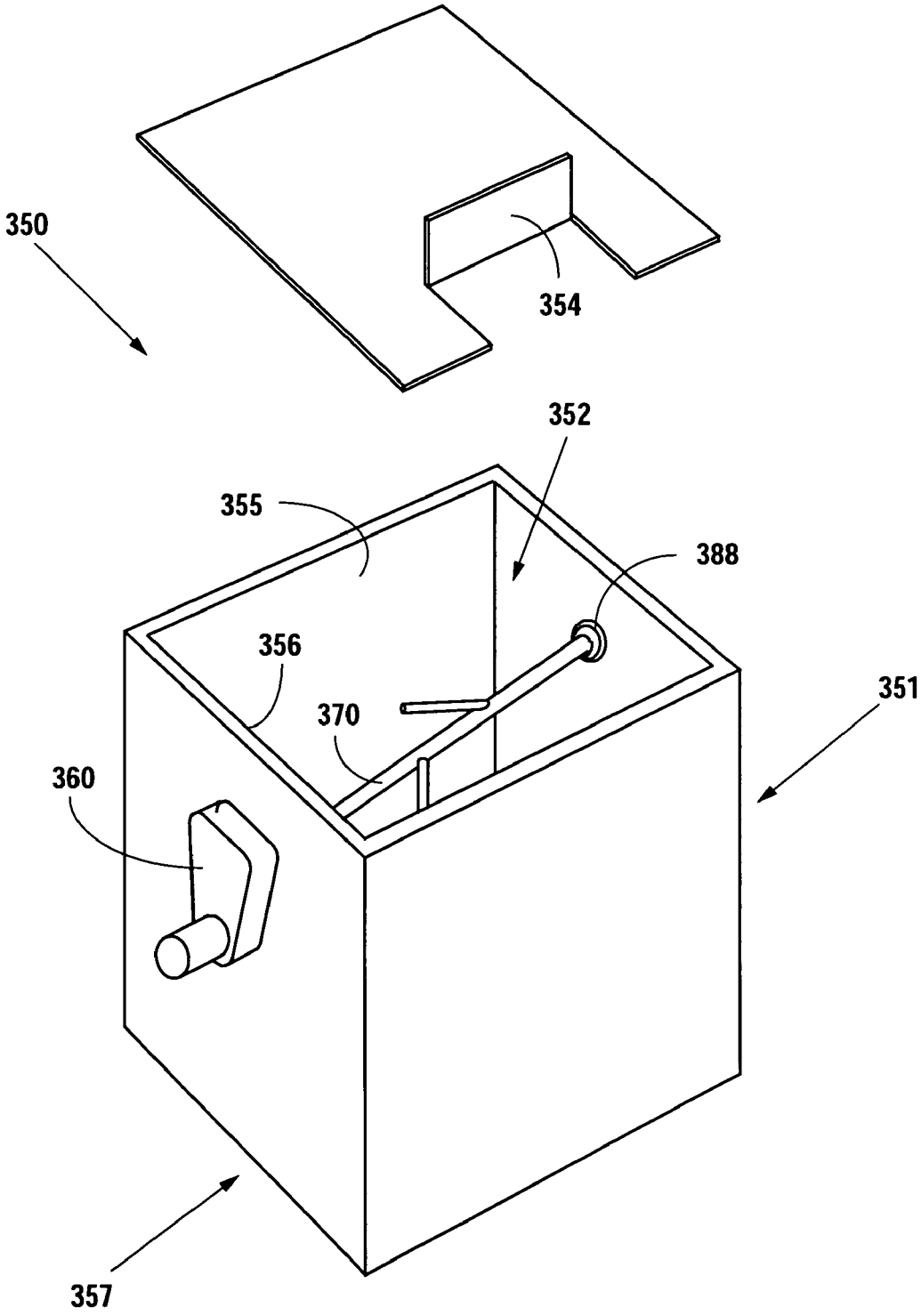
FIG. 1 provides a perspective view of an ice dispenser utilizing a front removable agitator motor assembly.
Figures 2A, 2B:
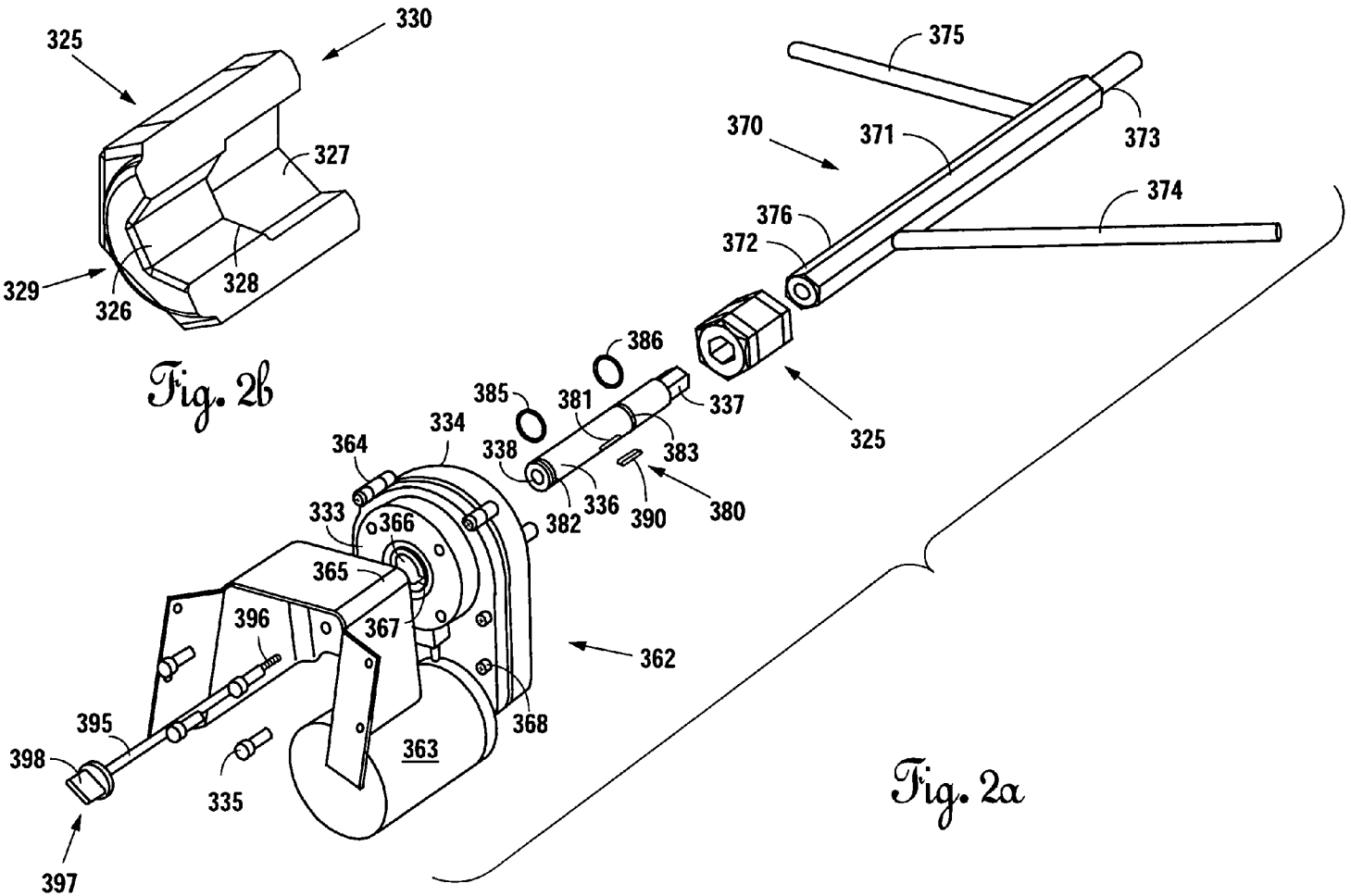
FIG. 2*a* provides an exploded view of a front removable agitator motor assembly according to a first embodiment.
FIG. 2*b* provides a section view of a hub according to the first embodiment.

As shown in FIGS. 1-2*b*, a first embodiment of an ice dispenser 350 includes a housing 351, a liner 355, a cover, an agitator bar assembly 370 disposed within the housing, and an agitator motor assembly 360 disposed exterior to the liner 355. The liner 355 defines a chamber 352. The liner 355 may be constructed of any suitable material that is able to contain a product, for example, ice. The liner 355 includes at least one access port 356 bridging the interior chamber 352 with the environment exterior to the liner 355, and a bearing support 388. The cover is adapted to fit on an upper end of the ice dispenser 350, such that the cover closes out the chamber 352. The cover may further include a door 354 or other access panel located near a front 357 of the housing 351, thereby providing access to the product stored within the chamber 352.

The agitator bar assembly 370 includes a shaft 371, a first arm 374, and a second arm 375. The shaft 371 is cylindrical in shape and includes a first end 372 and a second end 373. The first end 372 comprises a plurality of drive faces 376 that create a hexagonal shape, and includes a threaded bore 377. The second end 373 is adapted to mate with the bearing support 388 located on the liner 355. In this preferred embodiment, the agitator bar assembly 370 is constructed from stainless steel to provide increased strength and minimize corrosion.

The agitator motor assembly 360 includes a driver 362, a torsional loading mechanism 390, a drive shaft 380, and a lock bolt 395. In this preferred embodiment, the driver 362 is an electric motor 363 in combination with a gearbox 364. The gearbox 364 includes a first end 333, a second end 334, an output shaft 365, and a bore 366 that passes through the output shaft 365 and extends from the first end 333 to the second end 334 of the gearbox 364. The bore 366 is of a size suitable to accept the drive shaft 380. The bore 366 further includes an inset keyway 367 for accepting the torsional loading mechanism 390. In this preferred embodiment, the torsional loading mechanism 390 is a key disposed on the drive shaft 380. The torsional loading mechanism 390 is fabricated from stainless steel, such that it has the capacity to withstand high loading during rotation by the driver 362 and to resist corrosion. The gearbox 364 further includes a plurality of mounting holes 368 located on the first end 333. A plurality of mounting screws 335 pass through the mounting holes 368 to restrain the gearbox 364 during use.

The drive shaft 380 is cylindrical in shape and of suitable size to fit within the bore 366. The drive shaft 380 includes a first end 336, a second end 337, a bore 338, and a key slot 381. The drive shaft 380 includes a first snap ring groove 382 and a second snap ring groove 383. The bore 338 passes through the drive shaft 380. A first snap ring 385 fits in the first snap ring groove 382, and a second snap ring 386 fits within the second snap ring groove 383 to retain the drive shaft 380 in position when located within the bore 366 of the output shaft 365. The second end 337 of the drive shaft 380 includes a plurality of engagement faces 339. In this preferred embodiment, the second end 337 of the drive shaft 380 is hexagonal in shape to provide the drive engagement faces 339. However, one of ordinary skill in the art will recognize that virtually any number of engagement faces or any other load transfer means may be employed to transfer the loads to any connected components, such as flats on the shaft with a setscrew, direct engagement, splines, and the like. The key slot 381 is located on the outer surface and near the midpoint of the drive shaft 380. The key slot 381 is recessed to accept the torsional loading mechanism 390. Preferably, the drive shaft 380 is constructed from stainless steel to provide a high loading capacity, as well as to minimize the possibility of corrosion.

The lock bolt 395 is cylindrical in shape and includes a threaded end 396 and an activation end 397. The activation end 397 includes a handle 398 or other suitable engagement device for operator engagement. The threaded end 396 includes threads suitable for engagement with female threads of the same size and pitch. The lock bolt 395 is preferably constructed from stainless steel to prevent corrosion.

The ice dispenser 350 further includes a hub 325 having a first path 326, a second path 327, and a stop 328. The hub 325 may be any suitable form of mechanical alignment and connection, such that loads may be transferred from the first path 326 to the second path 327. In this preferred embodiment, the hub 325 is constructed from stainless steel to provide suitable strength and corrosion resistance properties. The hub 325 includes a first end 329 and a second end 330. The first end 329 includes the first path 326, a hexagonal passage into the hub 325. The first path 326 passes through to substantially a midpoint of the hub 325. The second end 330 includes the second path 327. In this preferred embodiment, the second path is, likewise, hexagonal in shape and passes through to the same midpoint, however, the second path 327 is rotated, such that the first path 326 and the second path 327 are not coincidental. Accordingly, the stop 328 is created between the two paths 326 and 327, thereby providing engagement interfaces for the mating components.

On assembly, the torsional loading mechanism 390 is placed in the key slot 381 on the shaft 380. The first end 336 of the shaft 380 is then inserted into the bore 366 located on the second end 334 of the gearbox 364. The shaft 380 is inserted into the bore 366 until the snap ring grooves 382 and 383 are on opposite sides of the gearbox 364. Once located, the first snap ring 385 may be installed in the first snap ring groove 382, and the second snap ring 386 may be installed into the second snap ring groove 383 of the drive shaft 380. Upon installation of the snap rings 385 and 386, the drive shaft 380 is restrained in the bore 366 of the gearbox 364. The agitator motor assembly 360 is then mounted to a front of the housing 351 or the outside of the chamber liner 355 using the mounting screws 335. In the installed position, the second end 337 of the shaft 380 protrudes through the access port 356 to gain entrance to the storage chamber 352.

Once the agitator motor assembly 360 is assembled, the second path 327 of the hub 325 is placed over the shaft 371 of the agitator bar assembly 370 and secured. The agitator bar assembly 370 and hub 325 are then placed into the chamber 352. The first path 326 of the hub 325 is placed over the second end 337 of the drive shaft 380. The second end 373 of the agitator bar assembly 380 is connected to the bearing support 388, such that the agitator bar assembly 380 is captured between the hub 325 and the agitator bar assembly 370, and is able to rotate with the drive shaft 380 within the chamber 352. The hub 325 may be permanently secured to the agitator bar assembly 370 using any suitable method of restraint, including drive pins, set screws, and the like. Once the agitator bar assembly 370 has been installed in the chamber 352, the agitator motor assembly 360 may be removed without removing the agitator bar assembly 370 from the chamber 352.

Once the agitator motor assembly 360 has been mounted, the threaded end 396 of the lock bolt 395 is inserted into the bore 338 of the drive shaft 380 until it engages the threads of the bore 377 of the agitator bar assembly 380. The lock bolt 395 is then rotated until the threads of the lock bolt 395 engage the threads of the agitator bar assembly 380, thereby securing all components in place.

While this first embodiment has been shown with a hub 325 and an agitator bar assembly 380, it should be clear to one of ordinary skill in the art that the hub 325 may be integral to the agitator bar assembly 380. Further extensions or variations of this embodiment may include a paddlewheel in lieu of the hub 325 or the agitator bar assembly 380 or both. One of ordinary skill in the art will further recognize that the various forms of agitator bar assemblies and/or paddlewheel combinations may be coupled to the agitator motor to agitate or dispense a product from the chamber 352.

Figure 3:
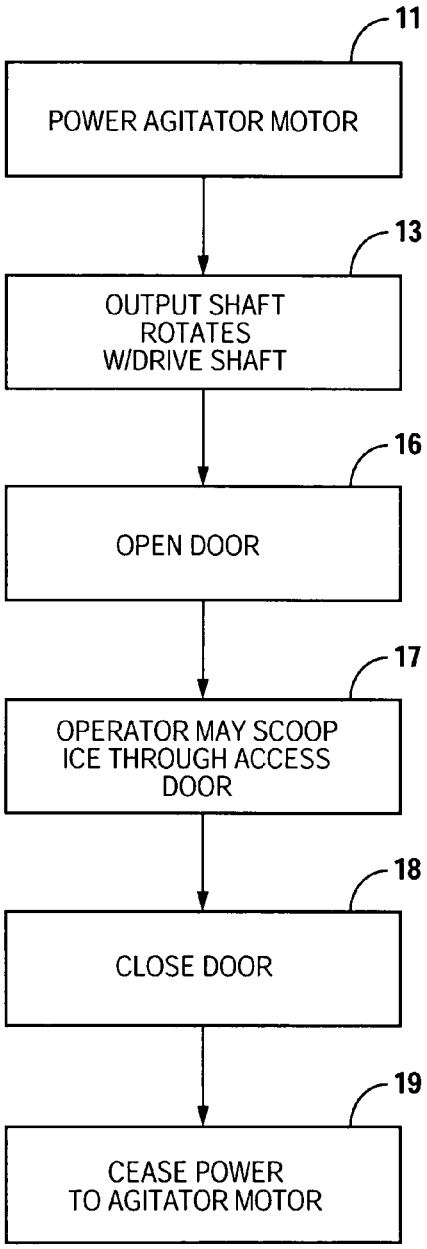
FIG. 3 provides a method flowchart for using the ice dispenser according to the first embodiment.

In use, the agitator motor assembly 360 rotates the agitator bar assembly 370 located within the chamber 352. As shown in the method flowchart of FIG. 3, the process commences with step 11, wherein electrical power is provided to the agitator motor assembly 360. Once powered, the agitator motor 220 rotates the gears in the gearbox 364 to rotate the output shaft 365, step 13. As the torsional loading mechanism 390 and the drive shaft 380 are connected to the output shaft 365, the drive shaft 380 and the connected hub 325 are forced to rotate with the output shaft 365. Rotation of the hub 325 further forces the agitator shaft assembly 380 to rotate within the chamber 352, thereby breaking up any large ice bridges that have formed in the chamber 352. Once the ice bridges have been addressed, an operator may open the door 354 as shown in step 16 to scoop ice from the chamber 352. After the desired amount of ice is retrieved from the chamber 352, the door 354 may be closed to provide maximum thermal protection, as shown in step 18. Power flow to the agitator motor assembly 360 is then ceased, step 19.

Figure 4:
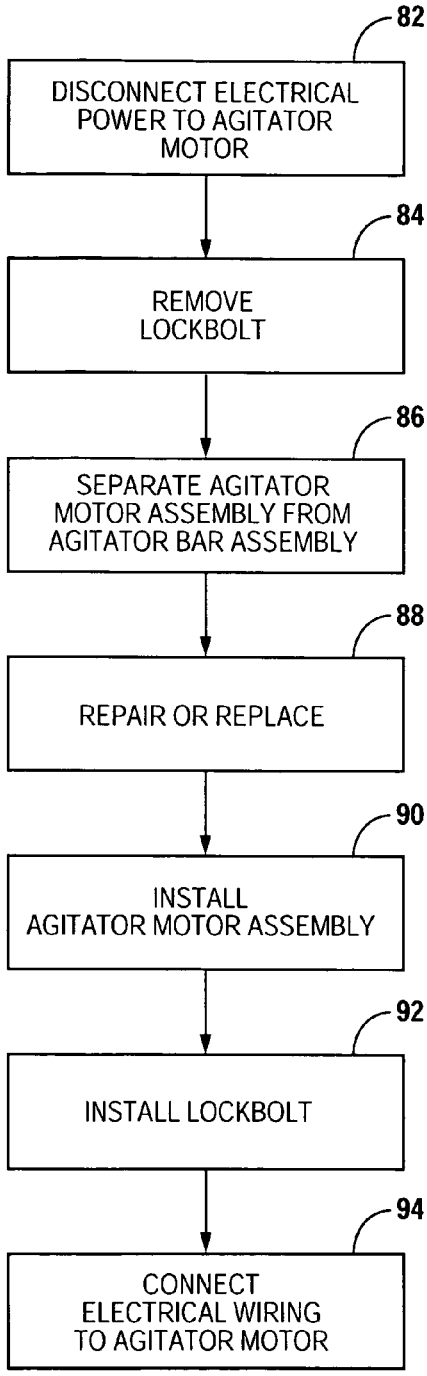
FIG. 4 provides a method flowchart for servicing a front removable agitator motor assembly according to the first embodiment.
Figure 5A:
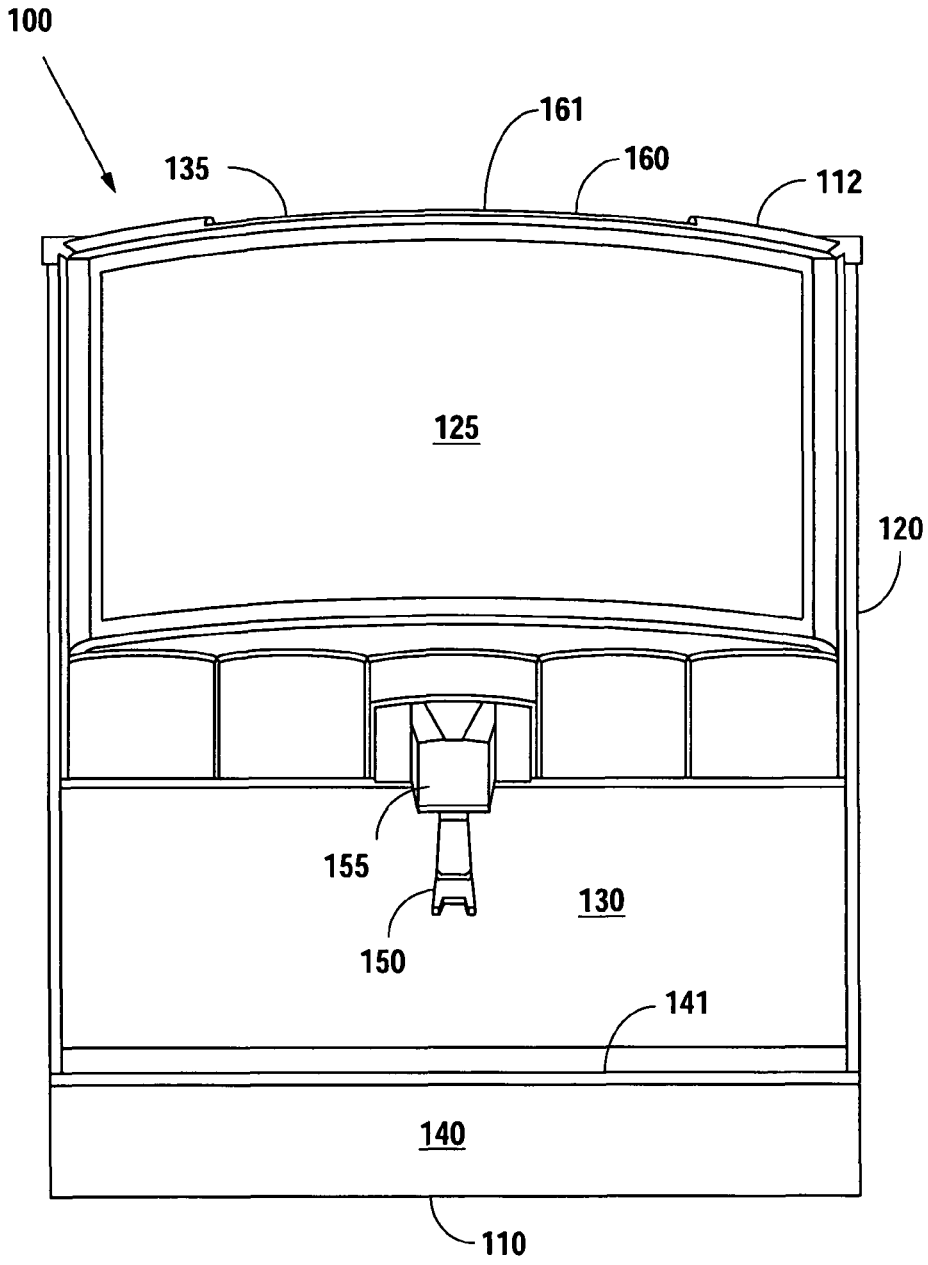
FIG. 5*a* provides a front view of an ice dispenser according to a second embodiment.
Figure 5B:
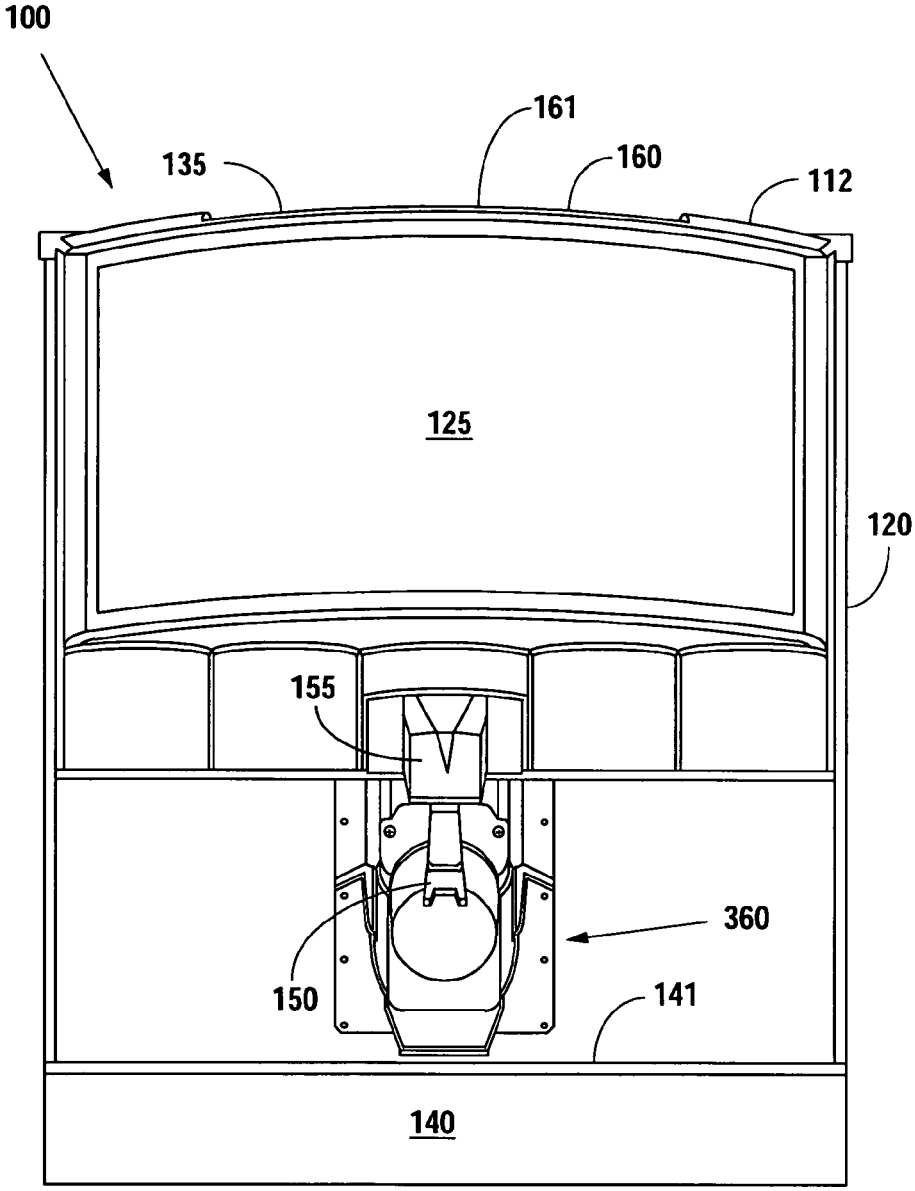
FIG. 5*b* provides a front view of a product dispenser with a splash plate removed according to the second embodiment.
Figure 5C:
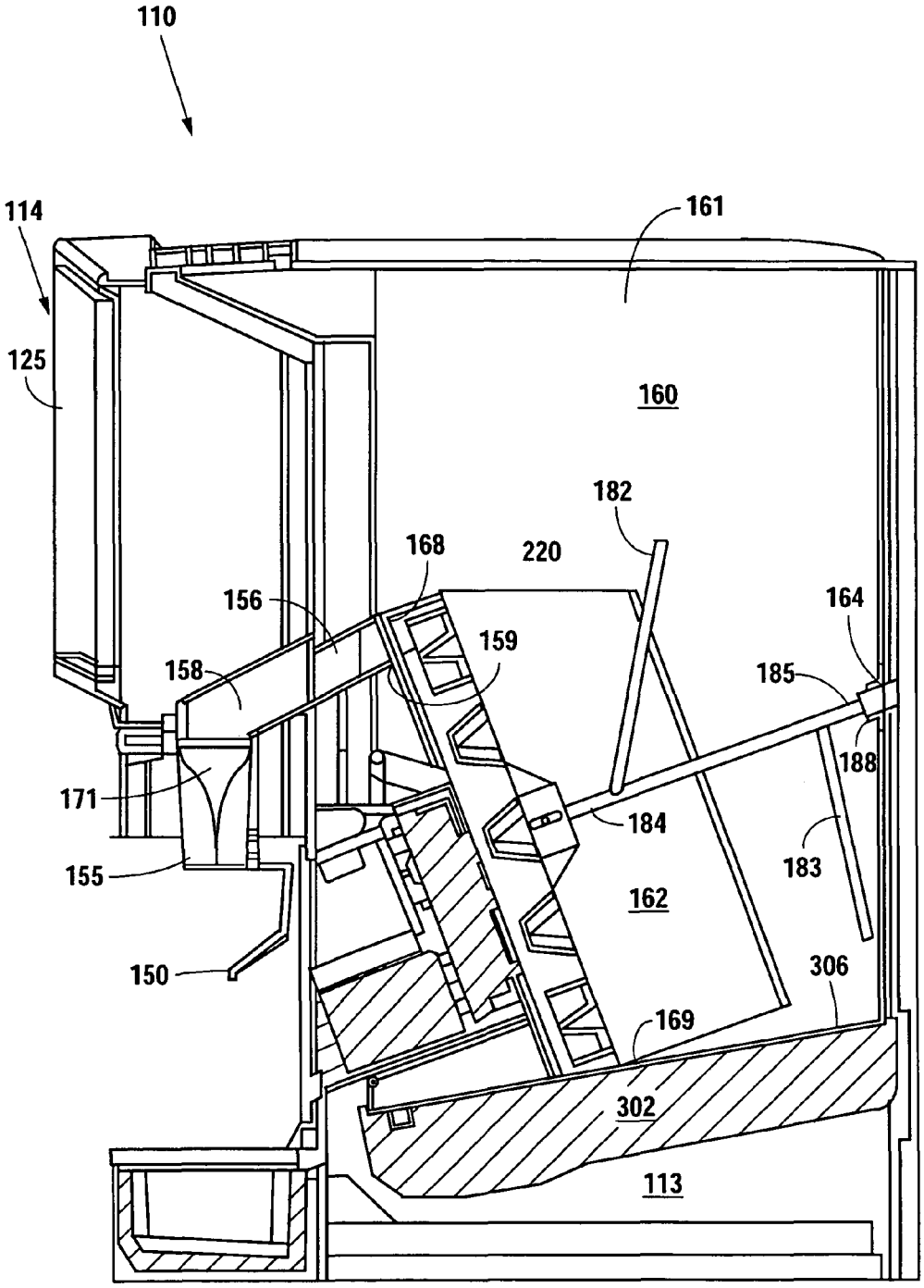
FIG. 5*c* provides a section view of a product dispenser including a front removable agitator motor assembly according to the second embodiment.
Figure 6:
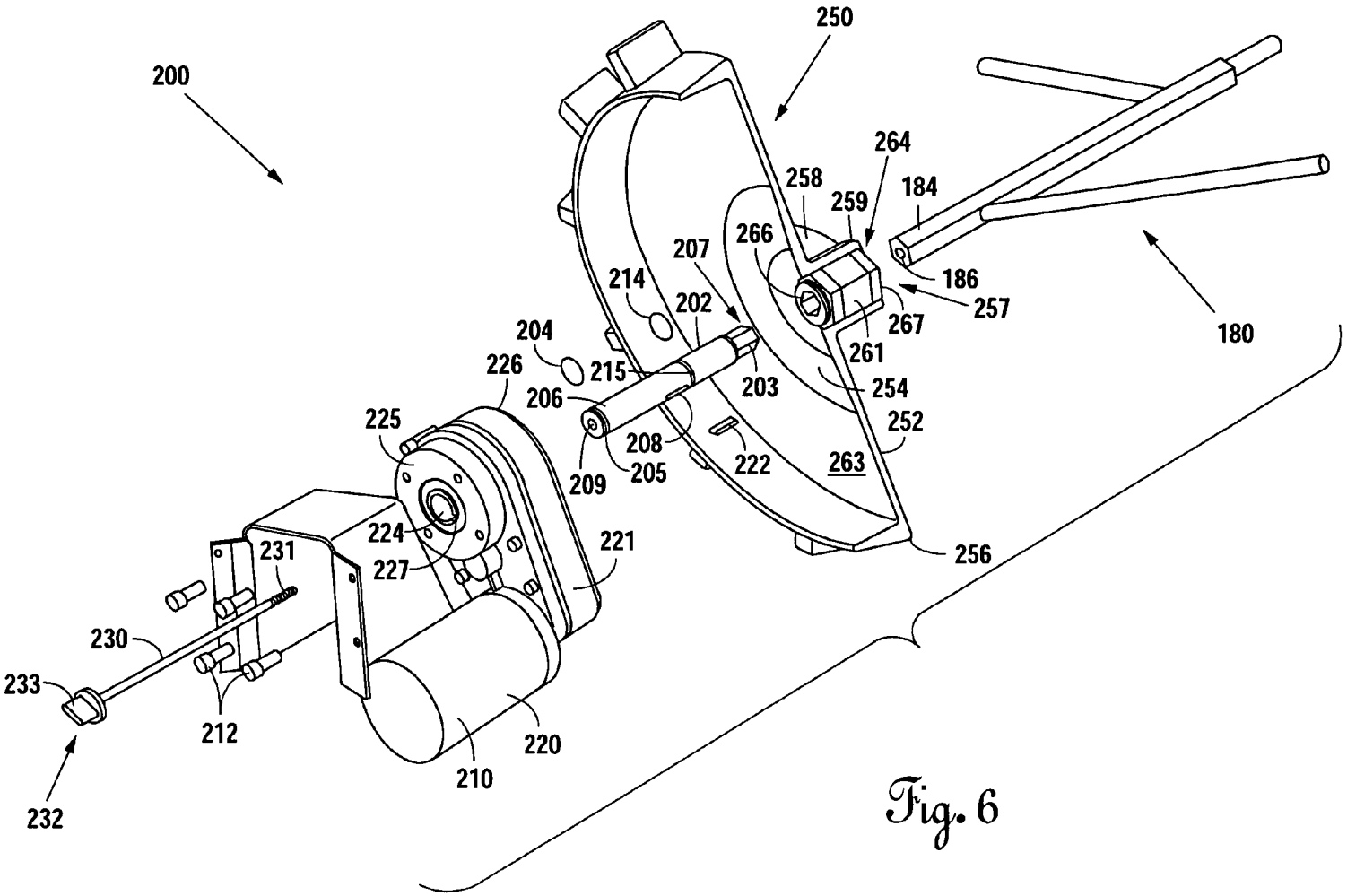
FIG. 6 provides an exploded view of the front removable agitator motor assembly according to the second embodiment.

Servicing of the agitator motor assembly 360 is accomplished from the front 357 of the ice dispenser 350. As shown in the method flowchart of FIG. 4, the removal process begins with step 82, wherein the electrical connections are disconnected to free the agitator motor assembly 360 from the ice dispenser 350. Step 84 provides for rotating the lock bolt 395 counter-clockwise to disengage the threads of the lock bolt 395 from the threads of the agitator bar assembly 360. The mounting screws 335 of the agitator motor assembly 360 are then disengaged from the ice dispenser 350 to remove the agitator motor assembly 360, step 86. Once removed, the agitator motor assembly 360 may be serviced or replaced as necessary, as shown in step 88. In step 90, the newly serviced or replacement agitator motor assembly 360 must be aligned with the first path 326 of the hub 325 and installed. Once aligned and in place, the lock bolt 395 is installed to restrain the assembled components, step 92. Once reinstalled, the electrical connections are reconnected, step 94.

In a second embodiment, an ice dispenser 100 includes a paddlewheel 250 to provide dispensing capabilities to the ice dispenser 100. As shown in FIGS. 1-6, a product dispenser 100 includes a housing 110, a wrapper 120, a lid 135, a marquis 125, and a drip tray 140. The housing 110 is any suitable structure that can be used to support and thermally isolate the product dispensing system 100. The wrapper 120 is disposed around the housing to protect the interior components. The marquis 125 is utilized to close out an upper portion of a front 114 of the housing 110, and to provide an area for merchandising. A splash plate 130 and the drip tray 140 close out a lower portion of the front 114 of the product dispenser 100. The splash plate 130 is utilized to contain splashes associated with the dispensing of products from the product dispenser 100. Errant splashes hit the splash plate 130 and then flow downward into the drip tray 140 for containment. The splash plate 130 is removable for cleansing. The drip tray 140 often houses a cup rest 141 for supporting a cup, and the like, during a product dispense.

The housing 110 further includes a chamber liner 160, and an insulation 113. The chamber liner 160 is a hollow shell that substantially conforms to the interior shape of the housing 110, thereby creating a storage bin 161. The chamber liner 160 may rest on a top side 306 of a cold plate 302, thereby allowing the contents of the storage bin 161 and the cold plate 302 to thermally interact. The cold plate 302 is disposed within the housing 110 at an angle of substantially ten degrees, such that anything on the top face 306 of the cold plate 302 will move toward the front 114 of the product dispenser 100. The insulation 113 is located between the chamber liner 160 and the housing 110, thereby keeping the storage bin 161 of the chamber liner 160 insulated. A lid 135 may also be employed to close out the storage bin 161, as well as a top 112 of the product dispenser 100.

The chamber liner 160 includes a cylindrical inset 162, the axis of which is substantially parallel to the angle of the cold plate 302. The cylindrical inset 162 includes an inner face 168, a cylindrical wall 169, and a lower shaft aperture 163 located on the axis of the cylindrical inset 162. The chamber liner 160 further includes an upper shaft aperture 164. A shaft 205 of the agitator motor assembly 200 protrudes through the lower shaft aperture 163, thereby gaining access to an interior of the storage chamber 161.

The agitator motor assembly 200 includes a driver 210, a torsional loading mechanism 222, a drive shaft 202, and a lock bolt 230. In this preferred embodiment, the driver 210 is an electric motor 220 in combination with a gearbox 221. The gearbox 221 includes a first end 225, a second end 226, an output shaft 223, and a bore 224 that passes through the output shaft 223 and extends from the first end 225 to the second end 226 of the gearbox 221. The bore 224 is of a size suitable to accept the shaft 202. The bore 224 further includes an inset keyway 227 for accepting the torsional loading mechanism 222. In this second embodiment, the torsional loading mechanism 222 is a key disposed on the shaft 205. The torsional loading mechanism 222 is fabricated from stainless steel, such that it has the capacity to withstand high loading during rotation by the driver 210 and to resist corrosion. The gearbox 221 further includes a plurality of mounting holes 211 passing from the first end 225 to the second end 226 of the gearbox 221. A plurality of mounting screws 212 pass through the mounting holes 211 to restrain the gearbox 221 during use.

The drive shaft 202 is cylindrical in shape and of suitable size to fit within the bore 224. The drive shaft 202 includes a first end 206, a second end 207, a bore 209, and a key slot 208. The first end 206 of the drive shaft 202 includes a first snap ring groove 205, and the second end 207 includes a second snap ring groove 215. The bore 209 passes through the drive shaft 202. A first snap ring 204 fits in the first snap ring groove 205, and a second snap ring 214 fits within the second snap ring groove 215 to retain the drive shaft 202 in position when located within the bore 224 of the gearbox 221. The second end 207 of the drive shaft 202 includes a plurality of engagement faces 203. In this preferred embodiment, the second end 207 of the shaft 202 is hexagonal in shape to provide the drive engagement faces. However, one of ordinary skill in the art will recognize that virtually any number of engagement faces or any other load transfer means may be employed to transfer the loads to any connected components, such as flats on the shaft with a setscrew, direct engagement, splines, and the like. The key slot 208 is located on the outer surface and near the midpoint of the drive shaft 202. The key slot 208 is recessed to accept the torsional loading mechanism 222. Preferably, the drive shaft 202 is constructed from stainless steel to provide a high loading capacity, as well as to minimize the possibility of corrosion.

The lock bolt 230 is cylindrical in shape and includes a threaded end 231 and an activation end 232. The activation end 232 includes a handle 233 or other suitable engagement device for operator engagement. The threaded end 231 includes threads suitable for engagement with female threads of the same size and pitch. The lock bolt 230 is preferably constructed from stainless steel to prevent corrosion.

The dispensing system 100 further includes a paddlewheel 250 and an agitator bar assembly 180. The paddlewheel 250 includes a truncated conical body 254 having a front face 252, an outer periphery 256, and a protrusion 299 having a central aperture 257. The central aperture 207 passes through the paddlewheel 250 along the conical axis. A plurality of gussets 258 provides radial support for the protrusion 259. The paddlewheel 250 further includes tangs 260 that extend radially from the outer periphery 256. The paddlewheel 250 further includes an internal hub 261. The hub 261 is disposed within the protrusion along the conical axis. The hub 261 includes a bore 262 passing from a first side 263 of the paddlewheel 250 to a second side 264 of the paddlewheel 250. In this preferred embodiment, the bore 261 includes two hexagonally shaped paths, a first path 266 and a second path 267. The first path 266 provides an engagement interface for the second end 207 of the drive shaft 202. The second path 267 is shifted out of phase approximately at a midpoint of the bore 262 to provide two separate engagement paths and to provide a stop 269 for any engaging components.

The agitator bar assembly 180 includes a shaft 181, a first arm 182, and a second arm 183. The shaft 181 and the arms are constructed from metallic bar, preferably stainless steel. The shaft 181 includes a first end 184 having a threaded bore 186, and a second end 185. The arms 182 and 183 are connected to the shaft 181 using any suitable means, for example welding. The first end 184 of the agitator bar assembly 180 is connectable to the second path 267 of the hub 261. The bore 186 includes threads suitable for mating with the threads of the lock bolt 230. The second end 185 of the shaft 181 is mountable to a bearing support 188 protruding through the upper shaft aperture 164. The bearing support 188 is suitably mounted to the housing 110 using any suitable means, including snap features, fasteners, or the like.

The product dispenser 100 further includes an ice delivery passage 156, an ice delivery chute 155, and an ice lever 150. The ice delivery passage 156 includes a first end 157 and a second end 158. The first end 157 of the ice delivery passage 156 is connected to an ice delivery port 159 located in the chamber liner 160. The ice delivery port 159 is located within an uppermost portion of the inner face 168 of the cylindrical inset 162. The second end 158 of the ice delivery passage 156 is connected to an ice exit port 171 located near the center of the front 114 of the housing 110. A chute 155 is mounted to the ice exit port 171 to direct the exiting ice downward. The lever 150 is mounted behind the chute 155 such that an operator may activate the lever 150 while holding a cup underneath the chute 155.

On assembly, the torsional loading device 222 is placed in the key slot 208 on the drive shaft 202. The first end 206 of the drive shaft 202 is then inserted into the bore 224 located on the second end 226 of the gearbox 221. The drive shaft 202 is inserted into the bore 224 such that the torsional loading device 222 aligns with the inset keyway 227. Once fully inserted, the snap rings 204 and 214 may be installed in the snap ring grooves 205 and 215 of the drive shaft 202. Upon installation of the snap rings 204 and 214, the drive shaft 202 is restrained in the bore 224 of the gearbox 221. The agitator motor assembly 200 is then mounted to the front 114 of the housing 110 or the outside of the chamber liner 160 using the mounting screws 212. In the installed position, the second end 207 of the drive shaft 202 protrudes through the lower shaft aperture 163 to gain entrance to the storage bin 161.

The paddlewheel 250 and the agitator bar assembly 180 are then installed within the storage bin 161. The paddlewheel 250 is inserted into the cylindrical inset 162 of the liner 160. The first path 266 of the paddlewheel hub 261 is then inserted over the second end 207 of the shaft 202. The paddlewheel 250 may be rotated to align the first path 266 with the hexagonal engagement faces 203 of the shaft 202. The paddlewheel 250 moves over the shaft 202 until the second end 207 reaches the stop 269 of the hub 261. The first end 184 of the agitator bar assembly 180 is then inserted into the second path 267 of the paddlewheel hub 261. The second end 185 of the agitator bar assembly 180 is connected to the bearing support 188.

Once the paddlewheel 250 and the agitator bar assembly 180 are installed, the threaded end 231 of the lock bolt 230 is inserted into the bore 224 of the drive shaft 202. The lock bolt 230 passes through the bore 224 of the drive shaft 202 to interface with the threaded bore 186 of the agitator bar assembly 180. The lock bolt 230 is rotated to engage the threads of the lock bolt 230 with the threads of the agitator bar assembly 180. In this position, the agitator motor assembly 200, the paddlewheel 250, and the agitator bar assembly 180 are captivated, such that the torsional loads from the driver 210 may be transferred to the torsional loading mechanism 222 and the drive shaft 202. In the engaged position, the paddlewheel 250 and the agitator bar assembly 180 rotate with the drive shaft 202.

Figure 7:
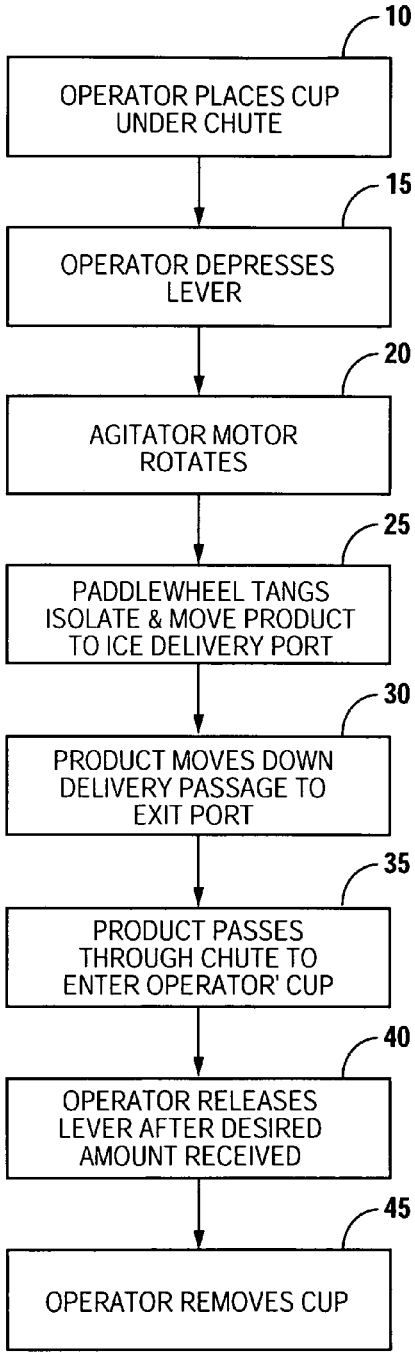
FIG. 7 provides a method flowchart for using the ice dispenser with the front removable agitator motor assembly.

In use, the agitator motor assembly 200 delivers a product from the chamber 161 to an operator's cup. As shown in the method flowchart of FIG. 7, the process commences with an operator placing a cup, or other suitable container, beneath the chute 155, step 10. The operator then depresses the lever 150, step 15, to close the switch to provide power to the motor 220. Upon receiving power, the agitator motor 220 rotates, thereby actuating the gearbox 221 and the output shaft 223, as shown in step 20. The output shaft 223 rotates the torsional loading mechanism 222 and the drive shaft 202 disposed in the bore 224 of the output shaft 223. The paddlewheel 250 and the agitator bar assembly 180 are forced to rotate with the drive shaft 202, thereby forcing the paddlewheel tangs 260 to isolate and move small portions of the product stored within the chamber 161 to the delivery port 159, step 25.

Once past the delivery port 159, the product moves through the delivery passage 156 to the exit port 171, as shown in step 30. The product then passes through the chute 155 to enter the operator's cup, step 35. The process continues until the operator determines that sufficient product has been delivered, at which point the operator releases the lever 150 to cease the delivery of power to the agitator motor 220, step 40. Ultimately, the operator removes the cup for use, as shown in step 45.

Figure 8:
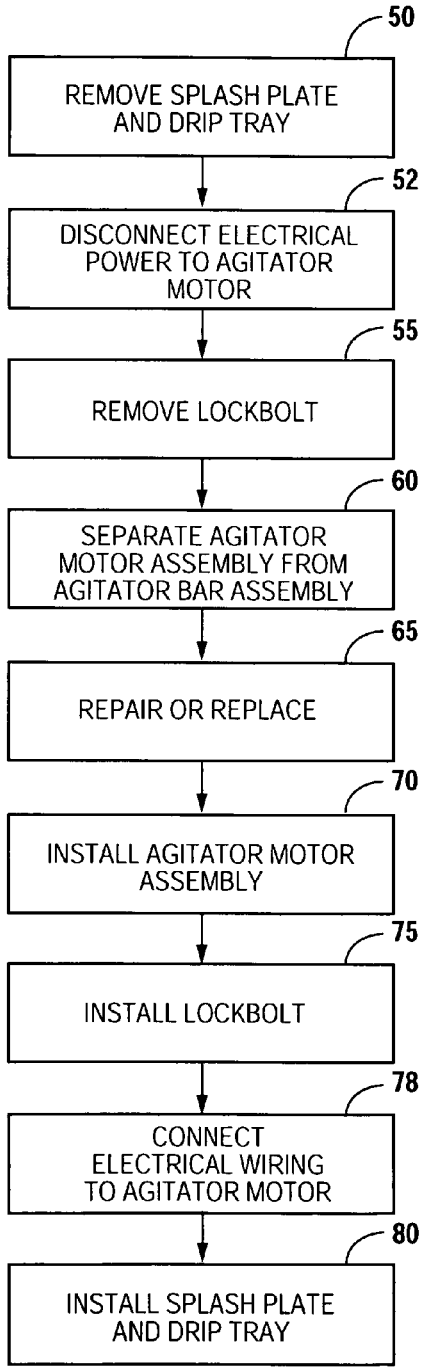
FIG. 8 provides a method flowchart for servicing the front removable agitator motor assembly according to the second embodiment.

Servicing of the agitator motor assembly 200 is accomplished from the front 114 of the product dispenser 100. As shown in the method flowchart of FIG. 8, the removal process begins with step 50, wherein the splash plate 130 and the drip tray 140 are removed from the product dispenser 100. Next, step 52, the electrical connections are disconnected to free the agitator motor assembly 200 from the product dispenser 100. Step 55 provides for rotating the lock bolt 230 counter-clockwise to disengage the threads of the lock bolt 230 from the threads of the agitator bar assembly 180. The mounting screws 212 of the agitator motor assembly 200 are then disengaged from the product dispenser 100 to remove the agitator motor assembly 200, step 60. Once removed, the agitator motor assembly 200 may be serviced or replaced as necessary, as shown in step 65. In step 70, the newly serviced or replacement agitator motor assembly 200 must be aligned with the first path 266 of the paddlewheel 250 and installed. Once aligned and in place, the lock bolt 230 is installed to restrain the assembled components, step 75. Once reinstalled, the electrical connections are reconnected, step 78. Finally, the splash plate 130 and the drip tray 140 may be reinstalled, as shown in step 80.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. An ice dispenser, comprising:

a housing including a bin having an access port and an ice dispensing port;

a paddlewheel disposed within the bin;

a driver disposed exterior and adjacent to the access port, the driver including a drive shaft having a connection with the paddlewheel for rotation thereof, wherein the connection between the drive shaft and the paddlewheel is established without accessing the bin, further wherein the connection between the drive shaft and the paddlewheel is released without accessing the bin such that the driver is removable from the ice dispenser without accessing the bin; and an agitator bar assembly having a connection with the paddlewheel such that rotation of the paddlewheel rotates the agitator bar assembly.

2. The ice dispenser according to claim 1, wherein the connection of the drive shaft to the paddlewheel comprises a hub, further wherein the drive shaft extends into a path in the hub.

3. The ice dispenser according to claim 2, wherein the agitator bar assembly includes a first end and a second end securable to the bin, further wherein the connection of the agitator bar assembly to the paddlewheel comprises the first end of the agitator bar assembly extending into a second path in the hub.

4. An ice dispenser, comprising:

a housing including a bin having an access port and an ice dispensing port;

a paddlewheel disposed within the bin, the paddlewheel including a hub;

a driver disposed exterior and adjacent to the access port, the driver including a drive shaft having a connection with the hub of the paddlewheel for rotation thereof, wherein the connection between the drive shaft and the hub is established without accessing the bin, further wherein the connection between the drive shaft and the hub is released without accessing the bin such that the driver is removable from the ice dispenser without accessing the bin; and an agitator bar assembly having a connection with the hub such that rotation of the paddlewheel rotates the agitator bar assembly.

5. The ice dispenser according to claim 4, wherein the hub includes a path that receives the drive shaft therein.

6. The ice dispenser according to claim 5, wherein the agitator bar assembly includes a first end extending into a second path in the hub and a second end securable to the bin.

7. An ice dispenser, comprising:

a housing including a bin having an access port;

an agitator bar assembly disposed within the bin, wherein the agitator bar assembly includes a first end in proximity to the access port and a second end securable to the bin;

a driver disposed exterior and adjacent to the access port, the driver including a drive shaft having a connection with the first end of the agitator bar assembly for rotation thereof, wherein the connection between the drive shaft and the agitator bar assembly is established without accessing the bin, further wherein the connection between the drive shaft and the first end of the agitator bar assembly is released without accessing the bin such that the driver is removable from the ice dispenser without accessing the bin.

8. The ice dispenser according to claim 7, wherein the connection of the drive shaft to the agitator bar assembly comprises a hub, further wherein the drive shaft extends into a first path in the hub and the first end of the agitator bar assembly extends into a second path in the hub.

9. The ice dispenser according to claim 8, further comprising a paddlewheel disposed within the bin and connected with the hub for delivering ice within the bin to an ice dispensing port.

10. The ice dispenser according to claim 7, wherein the agitator bar assembly includes a hub, further wherein the drive shaft extends into a first path in the hub and the first end of the agitator bar assembly extends into a second path in the hub.

11. The ice dispenser according to claim 10, further comprising a paddlewheel disposed within the bin and connected with the hub for delivering ice within the bin to an ice dispensing port.

12. An ice dispenser, comprising:

a housing including a bin having an access port;

an agitator bar assembly disposed within the bin, wherein the agitator bar assembly includes a hub at a first end in proximity to the access port and a second end securable to the bin;

a driver disposed exterior and adjacent to the access port, the driver including a drive shaft having a connection with the hub of the agitator bar assembly for rotation thereof, wherein the connection between the drive shaft and the hub is established without accessing the bin, further wherein the connection between the drive shaft and the hub is released without accessing the bin such that the driver is removable from the ice dispenser without accessing the bin.

13. The ice dispenser according to claim 12, wherein the hub includes a path that receives the drive shaft therein.

14. The ice dispenser according to claim 13, further comprising a paddlewheel disposed within the bin and connected with the hub for delivering ice within the bin to an ice dispensing port.

* * * * *